US006158067A

United States Patent [19]

Cheng

[11] Patent Number: 6,158,067

[45] Date of Patent: Dec. 12, 2000

[54] CONVERTIBLE CRIB

[75] Inventor: Kenny Cheng, No. 16, Lane 47, Chih Feng St., Taipei, Taiwan

[73] Assignee: Kenny Cheng, Taipei, Taiwan

[21] Appl. No.: 09/340,342

[22] Filed: Jun. 25, 1999

[51] Int. Cl.[7] ..... A47D 9/02

[52] U.S. Cl. ..... 5/106; 5/105; 5/99.1

[58] Field of Search ..... 5/101, 102, 103, 5/104, 105, 106, 107, 108, 99.1, 93.1

[56] References Cited

U.S. PATENT DOCUMENTS

| | | | |
|---|---|---|---|
| 149,178 | 3/1874 | Wright | 5/106 |
| 155,683 | 10/1874 | Strong | 5/106 |
| 287,721 | 10/1883 | Ranney | 5/106 |
| 744,993 | 11/1903 | Barta | 5/106 X |
| 2,106,927 | 2/1938 | Kinnear | 5/106 |
| 4,021,867 | 5/1977 | Maxwell, Jr. | 5/106 |
| 5,485,655 | 1/1996 | Wang | 5/98.1 X |
| 5,779,386 | 7/1998 | Eichhorn | 403/329 |
| 5,956,786 | 9/1999 | Huang | 5/105 |
| 6,026,524 | 2/2000 | Barger | 5/93.1 |

FOREIGN PATENT DOCUMENTS

| | | | |
|---|---|---|---|
| 40419 | 7/1957 | Poland | 5/106 |

*Primary Examiner*—B. Dayoan
*Assistant Examiner*—Robert G. Santos
*Attorney, Agent, or Firm*—Salter & Michaelson

[57] ABSTRACT

An improved crib structure includes a crib capable of swinging in a natural rhythm, comprising a supporting frame having an upper rectangle and lower crossbars, the upper rectangle and crossbar being connected through four vertical rails at four corresponding corners of the upper rectangle and four ends of the crossbars; a supporting block being provided on each of the four ends of the lower crossbars respectively, a receiving hole being provided on the bottom surface of the supporting blocks; a pair of swinging rail being provided between two corresponding supporting blocks, the swinging rail with both ends extending in the direction parallel to the vertical rails and the mid section extending in a shape of arch, each end of the swinging rail being detachably connected to the supporting block with a connecting device through said receiving hole. The swinging members are easy to connect to and detach from the crib because the convertible crib comprises a connecting device between the crib body and the swinging member, wherein the connecting device comprises a clicking means provided in each end of the swinging rail, a releasing means provided in a position on the supporting block corresponding to the clicking means for releasing the clicking between the swinging rail and supporting block.

4 Claims, 5 Drawing Sheets

CONVERTIBLE CRIB

BACKGROUND OF THE INVENTION

1. Field of the Invention

This invention relates to a crib and, more particularly, to improved convertible cribs capable of swinging in a natural rhythm.

2. Description of the Background Art

A variety of swinging cribs, which are also referred to as playpens, have been introduced these years. A majority of these products employ a design in which the crib includes two main parts, that is, a supporting frame and a crib body. The supporting frame is stable relative to the floor. A set of swinging arms is provided between the supporting frame and the crib body. In all instances, however, hinges of the swing arms are exposed for creating a safety hazard for a child within the crib or a parent nursing the child.

In addition to the above products, there are some other cribs featuring a set of swinging legs similar to the ones provided in a rocking chair While the prior art generally disclose various features in cribs and playpens, none disclose the structure by which applicant's crib may be readily converted between cribs with and without the function of swinging in a natural rhythm by an operator.

Therefore, it is an object of this invention to provide a crib capable of swinging in a natural rhythm, comprising a supporting frame having an upper rectangle and lower crossbars, the upper rectangle and crossbar being connected through four vertical rails at four corresponding corners of the upper rectangle and four ends of the crossbars; a supporting block being provided on each of said four ends of the lower crossbars respectively, a receiving hole being provided on the bottom surface of the supporting blocks; a pair of swinging rail being provided between two corresponding supporting blocks, the swinging rail with both ends extending in the direction parallel to the vertical rails and the mid section extending in a shape of arch, each end of the swinging rail being detachably connected to the supporting block with a connecting device through said receiving hole.

It is a further object of the present invention to provide an improved crib, in which the swinging members are easy to connect to and detach from the crib. According to a principle of the present application, a convertible crib comprising a connecting device between the crib body and the swinging member is provided, wherein the connecting device comprises a clicking means provided in each end of the swinging rail, a releasing means provided in a position on the supporting block corresponding to the clicking means for releasing the clicking between the swinging rail and supporting block.

It is a further object of this invention to provide a crib wherein the connecting device comprises a first spring panel of substantially V-shape provided inside the tube at the ends of the swinging rail, a protrusion being provided on one end of said spring panel, the protrusion extending through a throughhole provided in a corresponding position on the swinging rail, and a second spring panel provided on the surface of the supporting block, the second spring panel being coupled to the supporting block by providing a connecting means at one end of the second spring panel, a protrusion being provided in the inside surface of the second spring panel so as to align with the protrusion of the first spring.

It is a further object of this invention to provide a crib wherein the supporting block comprises a stabilizing means for switching the crib from a swinging mode to a fixed mode.

It is a further object of this invention to provide a crib wherein the stabilizing means is a rod pivotally coupled to the supporting block by providing a pivotal connecting means on the upper end of the rod.

It is a further object of this invention to provide a swinging module for converting a crib into one capable of swinging in a natural rhythm. According to one principle of the invention, the swinging module comprises a pair of swinging rails with both ends extending in the direction parallel to the legs of the crib and the mid section extending in a shape of arch, a connecting block connected to each end of said swinging rail, and a hole being provided in the upper surface of said connecting block for detachably connecting said swinging rail to the legs of the crib such that the swinging rail is provided between two corresponding legs of the crib.

It is a further object of this invention to provide a swinging module, wherein the supporting block further comprises a stabilizing means for switching the crib from a swinging mode to a fixed mode.

It is a further object of this invention to provide a swinging module, wherein the stabilizing means is a rod pivotally coupled to the supporting block by providing a pivotal connecting means on the upper end of said rod.

Lastly, it is an object of the present invention to more safely, efficiently, conveniently and economically fabricate and use convertible cribs.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure.

Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into a convertible crib transferable between a fixed mode and a swinging mode.

In addition, the invention may also be incorporated into an improved crib structure which includes a crib capable of swinging in a natural rhythm, comprising a supporting frame having an upper rectangle and lower crossbars, the upper rectangle and crossbar being, connected through four vertical rails at four corresponding corners of the upper rectangle and four ends of the crossbars; a supporting block being provided on each of the four ends of the lower crossbars respectively, a receiving hole being provided on the bottom surface of the supporting, blocks; a pair of swinging rail being provided between two corresponding supporting blocks, the swinging rail with both ends extending in the direction parallel to the vertical rails and the mid section extending in a shape of arch, each end of the swinging rail being detachably connected to the supporting block with a connecting device through the receiving hole.

The present invention further relates to an improved crib, in which the swinging members are easy to connect to and detach from the crib. According to a principle of the present application, a convertible crib comprising a connecting device between the crib body and the swinging member is provided, wherein the connecting device comprises a clicking means provided on each end of the swinging rail, a releasing means provided in a position on the supporting block corresponding to the clicking means for releasing the clicking between the swinging rail and supporting block.

This invention relates to a crib wherein the connecting device comprises a first spring panel of substantially V-shape provided inside the tube at the ends of the swinging rail, a protrusion being provided in one end of the spring panel, the protrusion extending through a throughhole provided in a corresponding position on the swinging rail, and a second spring panel provided in the surface of said supporting block, the second spring panel being coupled to the supporting block by providing a connecting means at one end of the second spring panel, a protrusion being provided on the inside surface of the second spring panel so as to align with the protrusion of the first spring.

It is a further object of this invention to provide a crib wherein the supporting block comprises a stabilizing means for switching the crib from a swinging mode to a fixed mode.

It is a further object of this invention to provide a crib wherein the stabilizing means comprises a rod pivotally coupled to the supporting block by providing a pivotal connecting means on the upper end of the rod, the rod being downwardly positioned during a fixed mode, and upwardly positioned during a swinging mode.

It is a further object of this invention to provide a swinging module for converting a crib into one capable of swinging in a natural rhythm. According to one principle of the invention, the swinging module comprises a pair of swinging rails with both ends extending in the direction parallel to the legs of the crib and the mid section extending in a shape of arch, a connecting block connected to each end of said swinging rail, and a hole being provided in the upper surface of said connecting block for detachably connecting said swinging rail to the legs of the crib such that said swinging rail is provided between two corresponding legs of the crib.

It is a further object of this invention to provide a swinging module, wherein the supporting block further comprises a stabilizing means for switching the crib from a swinging mode to a fixed mode.

It is a further object of this invention to provide a swinging module, wherein the stabilizing means is a rod pivotally coupled to the supporting block by providing a pivotal connecting means on the upper end of said rod, such that the rod is downwardly positioned during a fixed mode, and upwardly positioned during a swinging mode.

Lastly, it is an object of the present invention to more safely, efficiently, conveniently and economically fabricate and use convertible cribs.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure.

The foregoing has outlined rather broadly the more pertinent and important features of the present invention in order that the detailed description of the invention that follows may be better understood so that the present contribution to the art can be more fully appreciated.

Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a further understanding of the nature and objects of the invention, reference should be had to the following detailed description taken in conjunction with the accompanying drawings in which.

Similar reference characters refer to similar part throughout the several Figures.

DETAILED DESCRIPTION OF THE INVENTION

Figure 1:
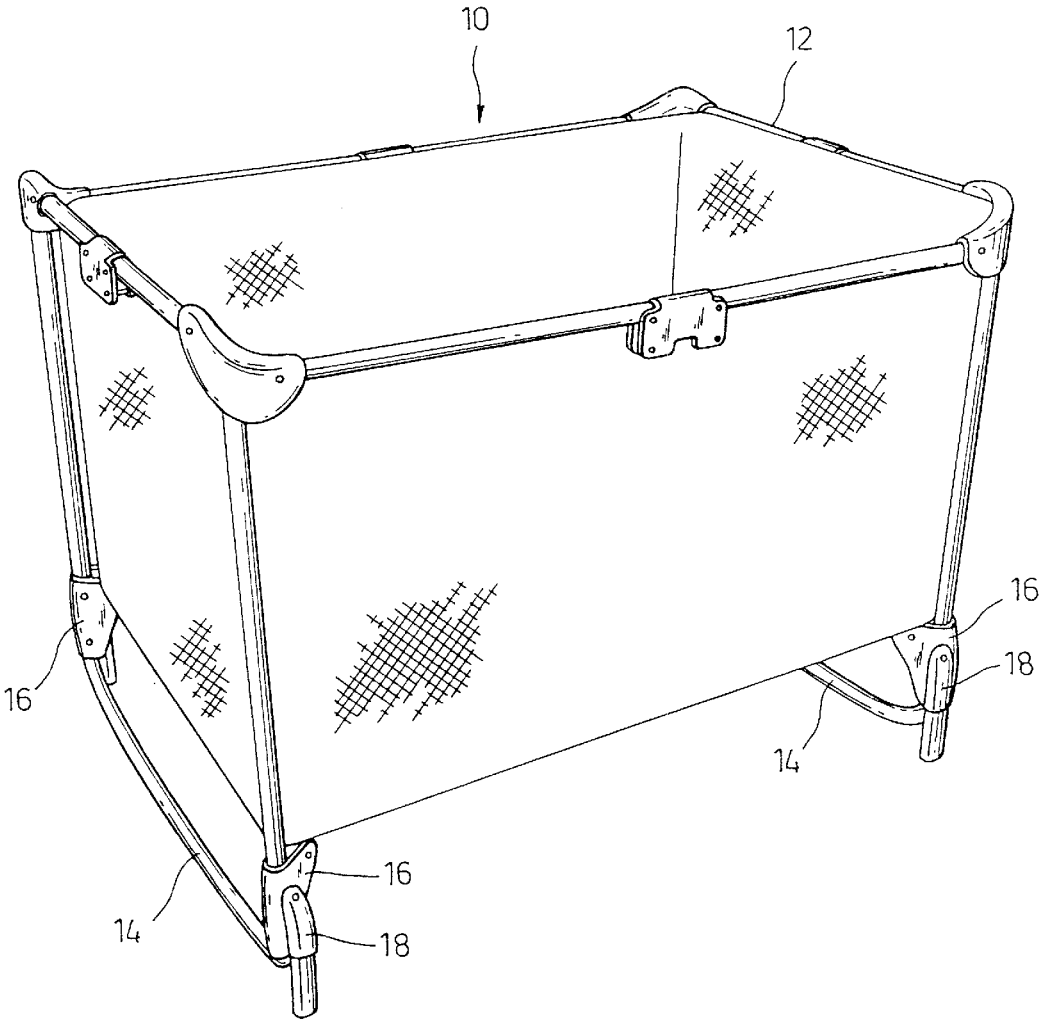
FIG. 1 is a perspective illustration of a convertible crib constructed in accordance with the principles of the present invention.

With particular reference to FIG. 1, there is shown a perspective illustration of a crib 10 constructed in accordance with the principles of the present invention.

The crib 10 includes a supporting frame 12 and swinging rails 14. The supporting frame includes an upper rectangle, a lower crossbars (not shown), the upper rectangle and lower cross bars are connected through four vertical rails at four corresponding corners of the upper rectangle and ends of the lower crossbars. A supporting block is provided in each of the four ends of the lower crossbars respectively.

A receiving hole is provided in the bottom surface of the supporting blocks for receiving a proper swinging member. In the first embodiment of the present application, a pair of swinging rails are employed as the swinging member for the convertible crib, in which a pair of swinging rails are provided between two corresponding supporting blocks.

Both ends of the swinging rail extend in the direction parallel to the vertical rails. The mid section of the swinging rail extend in a shape of arch, each end of the swinging rail is detachably connected to the supporting block with a connecting device through the receiving hole. To facilitate the coupling between the supporting block and the swinging member, it is preferable that the outer diameter of the ends of the swinging rail is slightly smaller than the inner diameter of the receiving hole. With the above arrangement, the ends of the swinging rail may be inserted into the receiving hole provided in the bottom surface of the supporting block without efforts, such that the swinging member may be coupled to the crib body easily by the user.

Under certain conditions, such as feeding and dipper replacing, a stable mode for the crib is desirable. For this purpose, the crib according to the first embodiment of the present application further comprises a stabilizing bar 16 provided in the supporting block for switching the crib from a swinging mode to a fixed mode. The connection relation between the stabilizing bar and the supporting block will be described hereinafter with reference to corresponding figures.

Figure 2A:
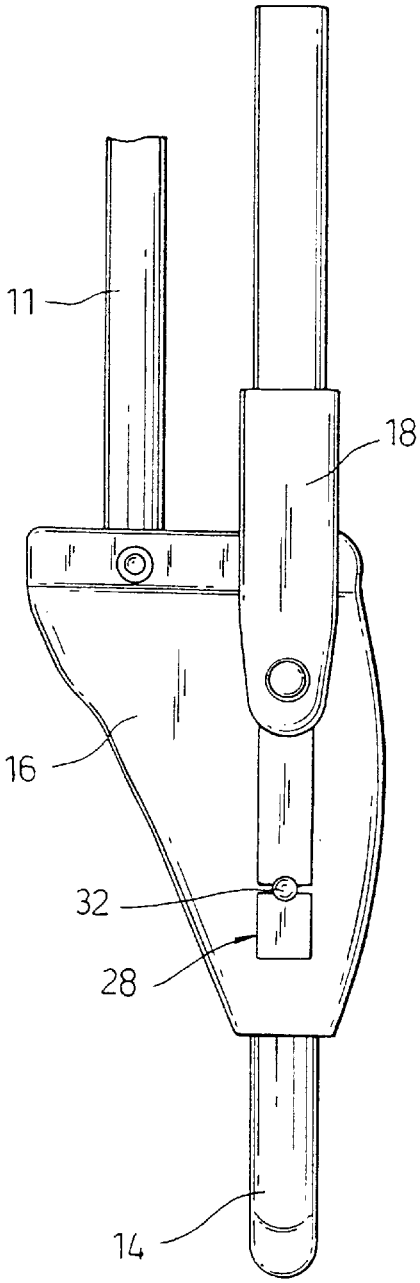
FIGS. 2A is a diagram according to the first embodiment of the present application, showings the front view of the supporting block of FIG. 1, with the stabilizing means located in a swinging mode position.
Figure 2B:
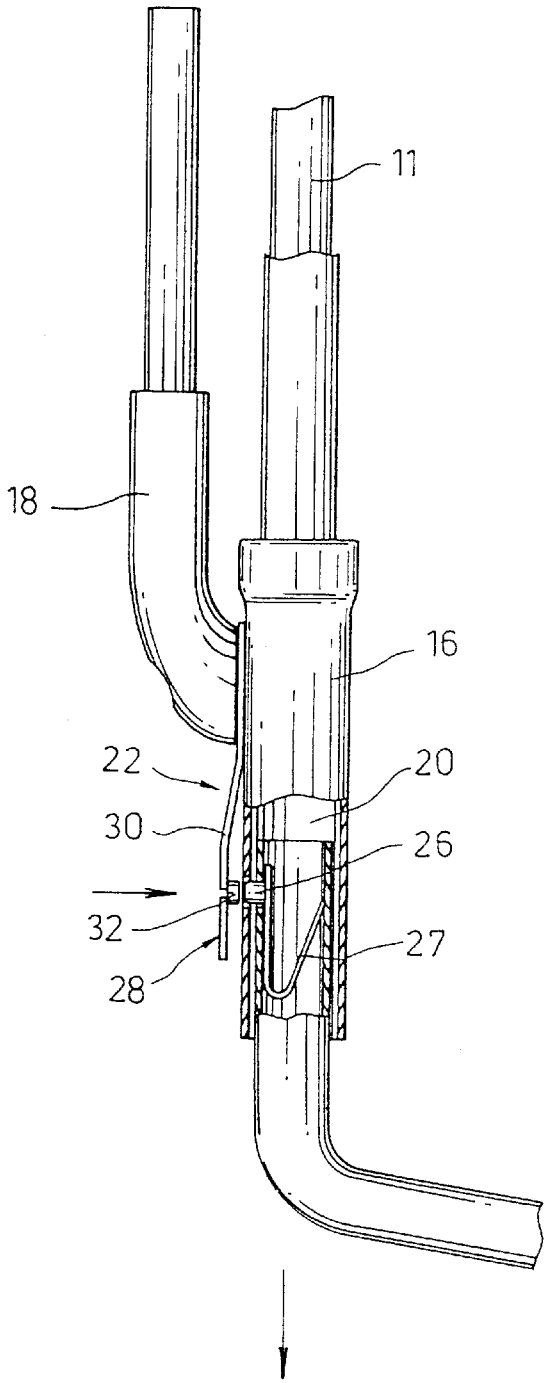
FIGS. 2B is a partial sectional view of the supporting block of FIGS. 2 taken from the left.

With reference to FIG. 2A and 2B, which are a front view and a side view of the supporting block respectively, the structure of the supporting block will be described in details.

The supporting block is provided on each of the four ends of the lower crossbars 11 respectively. A receiving hole 20 is provided on the bottom surface of each supporting blocks 16. As shown in FIG. 2B, a securing device 22 is provided on each supporting blocks 16 and inside the swinging rail 14 at its end portion. The securing device 22 comprises a clicking means 24 provided on each end of the swinging rails 14 for securing the connection between the crib body 10 and the swinging rails 14. The clicking means 24 comprises a V-shaped spring 27 and a protrusion 26 provided in outside surface of the V-shaped spring 27 at one end. A throughhole is provided in a position on the end portion of the swinging rail 14such that the protrusion 16 may extend from inside the swinging rail to outside through the throughhole. A throughhole is provided in a position on the supporting block corresponding to the protrusion 26 so that the protrusion 26 may extend from inside the supporting block 16 to the outside through this throughhole when the swinging rail 14 is coupled to the supporting block 16.

Also as shown in FIG. 2B, a releasing means 28 is provided on the supporting block 16 for releasing the clicking between said swinging rail 14 and supporting block 16. The releasing means 28 includes a flat spring panel 30 and a protrusion 32 provided on the inside surface of the flat spring panel 32 in a position corresponding to the clicking means such that the protrusion 32 aligns with the protrusion 26. As shown in FIG. 2B, in order to obtain access to the protrusion 26, the protrusion 32 abuts against the protrusion 26 when the swinging rail 14 is inserted into the receiving hole on the bottom of the supporting block 16. The depth of the protrusion 28 does not exceed the thickness of the corresponding portion of the wall of the supporting block 16.

Accordingly, a user may release the clicking between the supporting block 16 and the swinging rail 14 by pushing down with one hand on the lower portion of the flat spring panel 28, rendering the protrusion 26 to withdraw back to the inside of the supporting block 16, and then pulling the swinging rail 14 out of the receiving hole 20 with the other hand.

Figure 3A:
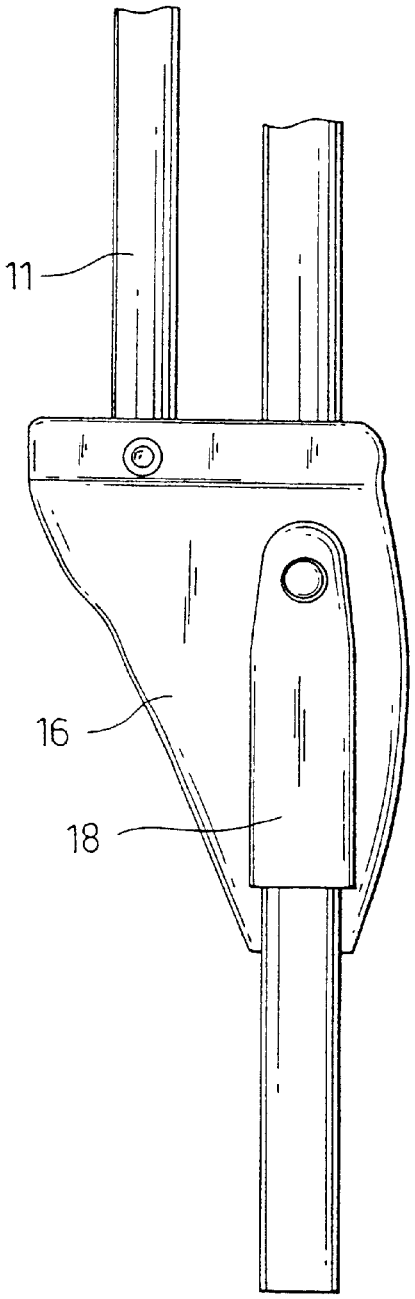
FIGS. 3A is a diagram showings the front view of the supporting block according to the first embodiment of the present application of FIG. 1, with the stabilizing means located in a fixed mode position.
Figure 3B:
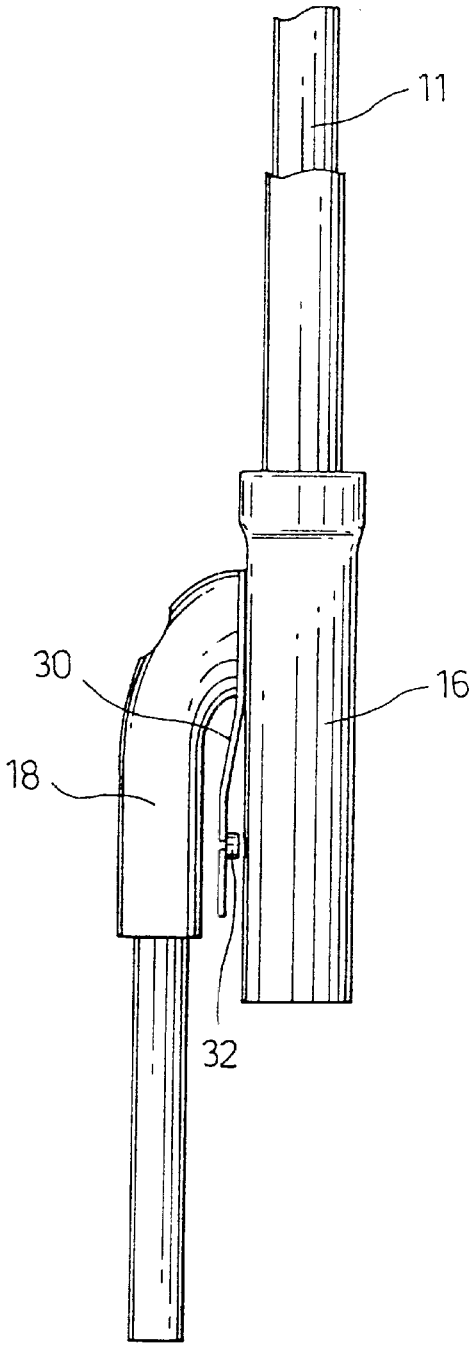
FIGS. 3B is a side view of the supporting block of FIGS. 2 taken from the left.

The reference now turn to FIGS. 3A, which is a diagram showing the front view of the supporting block according to the first embodiment of the present application of FIG. 1, with the stabilizing means located in a fixed mode position. As previously explained, under certain conditions, such as feeding and dipper replacing, a stable mode for the crib is desirable. For this purpose, the stabilizing bar 16 of the crib according to the first embodiment of the present application provided on the supporting block is in a downward position for switching the crib from a swinging mode to a fixed mode. It is noticed that the length of the stabilizing bar is of a sufficient length such that the swinging rail 14 will be hung without contacting the floor when the stabilizing bar is in a downward position. FIGS. 3B is a side view of the supporting block of FIGS. 3A. Other features of FIGS. 3A and 3B are the same as those of FIG. 2A and 2B, therefore the descriptions thereof are omitted.

Figure 4A:
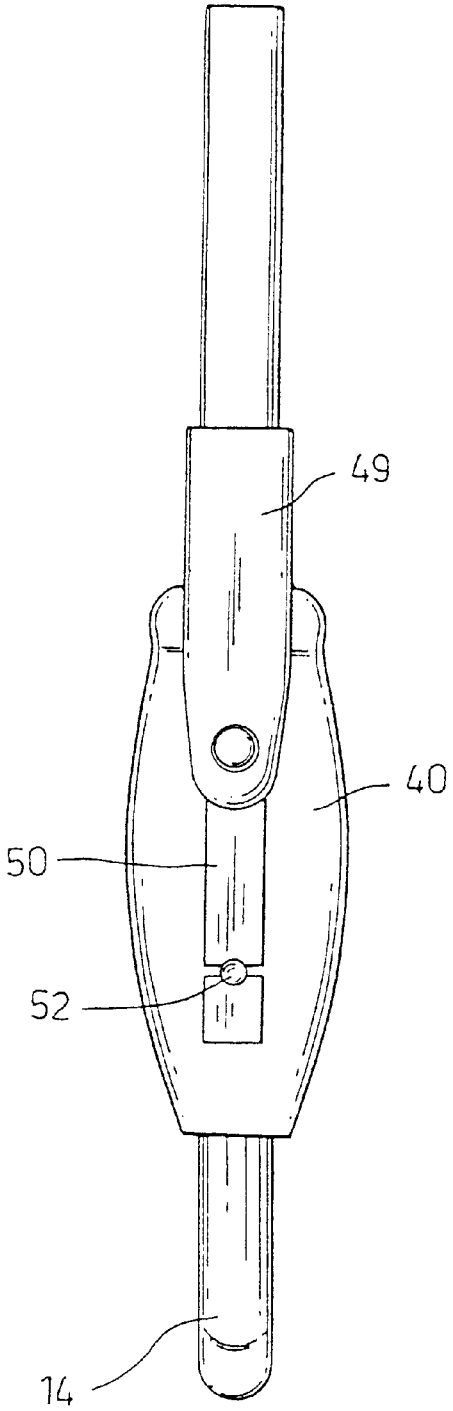
FIGS. 4A is a diagram according to the second embodiment of the present application, showings the front view of the supporting block, with the stabilizing means located in a swinging mode position.
Figure 4B:
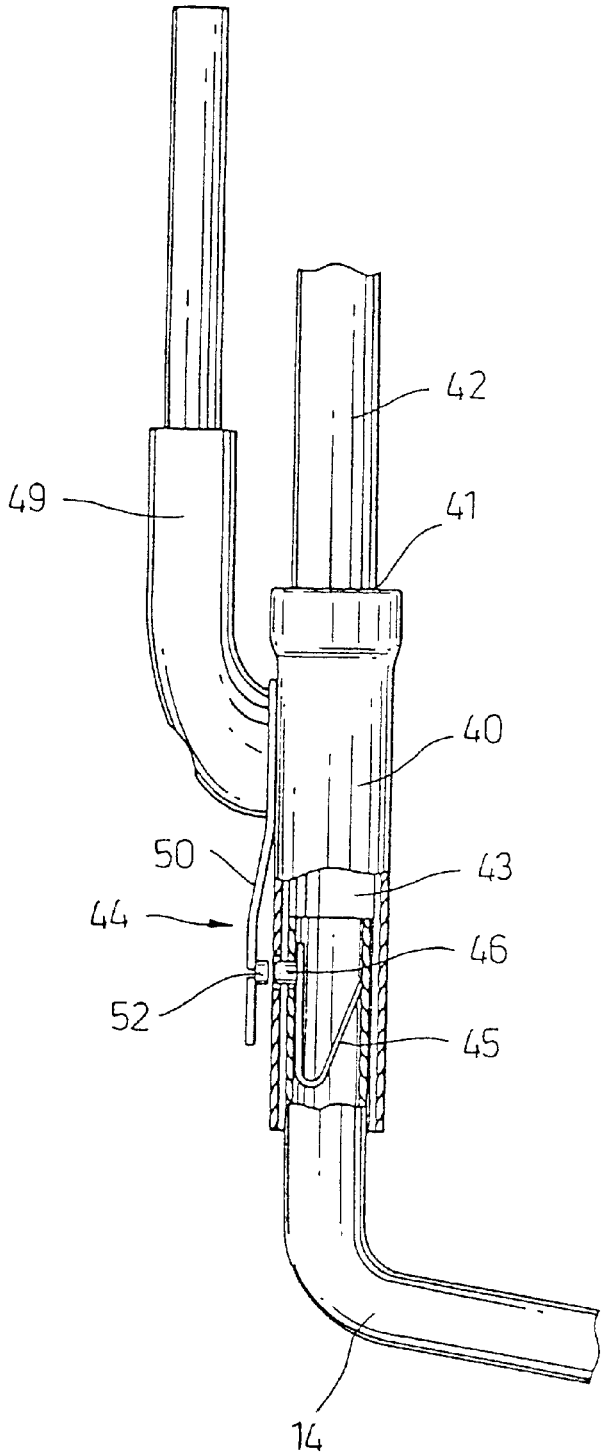
FIGS. 4B is a partial sectional view of the supporting block of FIGS. 4*a* taken from the left.

FIGS. 4A is a diagram according to the second embodiment of the present application, showing the front view of the supporting block, with the stabilizing means 49 located in a swinging mode position. FIGS. 4B is a partial sectional view of the supporting block of FIGS. 4A.

In the second embodiment of the present application, a swinging module for enabling an original crib to swing in a natural rhythm is introduced. The swinging module 40 is coupled to the crib body at each of the legs 42 respectively through a receiving hole 41 provided on the upper surface of the swinging module. To fit into the original crib properly, the receiving hole 41 may be formed in a shape corresponding to that of the bottom end of the legs of the crib. A receiving hole 43 is provided on the bottom surface of the swinging module 40.As shown in FIG. 4B, a securing device 44 is provided on the swinging module 40 and inside the swinging rail 14 at its end portion. The securing device 44 comprises a clicking means 45 provided on each end of the swinging rails 14 for securing the connection between the crib body 10 and the swinging rails 14. The clicking means 45 comprises a V-shaped spring and a protrusion 46 provided on outside surface of the V-shaped spring at one end. A throughhole is provided in a position on the end portion of the swinging rail 14such that the protrusion 46 may extend from inside the swinging rail to outside through the throughhole. A throughhole is provided in a position on the supporting block corresponding to the protrusion 46 so that the protrusion 46 may extend from inside the swinging module 40 to the outside through this throughhole when the swinging rail 14 is coupled to the swinging module 40.

Details of the structures of each swinging module 40 are best seen by reference to FIG. 4B. As shown in FIG. 4B, a releasing means 44 is provided on the swinging module 40 for releasing the clicking between said swinging rail 14 and swinging module 40. The releasing means 44 includes a flat spring panel 50 and a protrusion 52 provided in the inside surface of the flat spring panel 50 on a position corresponding to the clicking means such that the protrusion 52 aligns with the protrusion 46. As shown in FIG. 4B, in order to obtain access to the protrusion 46, the protrusion 52 abuts against the protrusion 46 when the swinging rail 14 is inserted into the receiving hole on the bottom of the swinging module 40. The depth of the protrusion 52 does not exceed the thickness of the corresponding portion of the wall of the swinging module such that the clicking relationship between the swinging module 40 and the swinging rail 14 may be properly released when the spring panel 50 is fully pushed inwardly.

Accordingly, a user may release the clicking between the swinging module 40 and the swinging rail 14 by pushing down with one hand on the lower portion of the flat spring panel 50, rendering the protrusion 46 to withdraw back to the inside of the swinging module 40, and then pulling the swinging rail 14 out of the receiving hole 43 with the other hand.

Figure 5A:
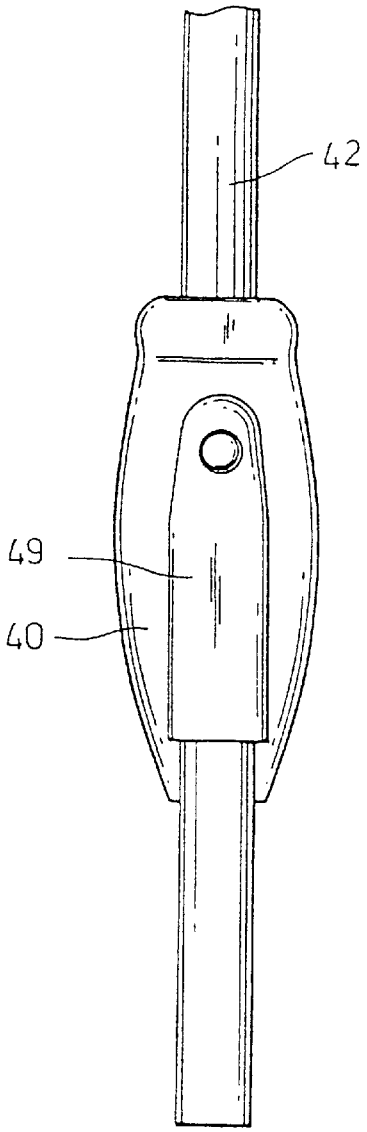
FIGS. 5A is a diagram showings the front view of the supporting block according to the second embodiment of the present application, with the stabilizing means located in a fixed mode position.
Figure 5B:
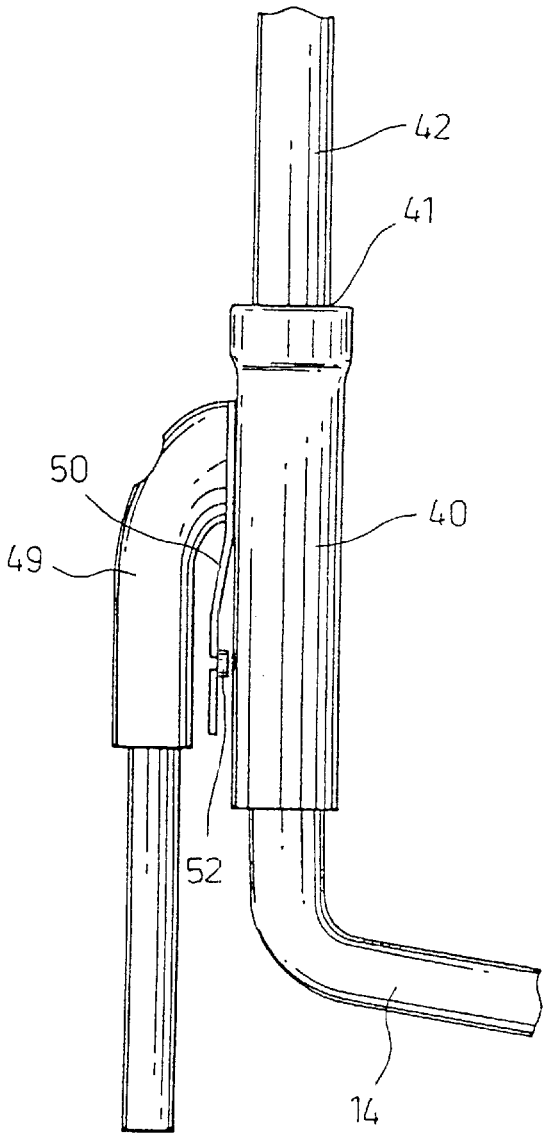
FIGS. 5B is a sectional view of the supporting block of FIGS. 5A taken from the left.

The reference now turn to FIG. 5A. FIG. 5A is a diagram showings the front view of the swinging module according to the second embodiment of the present application, with the stabilizing means located in a fixed mode position. As previously explained, under certain conditions, such as feeding and dipper replacing, a stable mode for the crib is desirable. For this purpose, the stabilizing bar 49 according to the second embodiment of the present application provided in the swinging module 40 is in a downward position for switching the crib from a swinging mode to a fixed mode. It is noticed that the length of the stabilizing bar is of a sufficient length such that the swinging rail 14 will be hung without contacting the floor when the stabilizing bar is in a downward position. FIGS. 5B is a side view of the swinging module of FIGS. 5A. Other features of FIGS. 5A and 5B are the same with that of FIG. 2A and 2B, therefore the descriptions thereof are omitted.

The system according to the present application involves a very simple method of operation. In the first embodiment, beginning with a crib 10 in a stable condition, the operator would first pull the crib 10 up at one end with one hand and then put the swinging rail 14 on the floor, with its ends pointing upwardly and aligning with the receiving holes of the corresponding supporting blocks. Once both of the ends are in a fully aligned condition, the operator may push the crib downwardly such that the swinging rail would coupled to the crib properly. This coupling relationship would be maintained by the securing device. This procedure is illustrated in the drawings provided at FIGS. 1, 2A and 2B. With the protrusions provided on the V-shaped springs fitted in the locking position of FIG. 2B, the swinging rails are locked in position. Releasing or separating the swinging rails from the crib simply involves the operator performing these steps in the reverse direction, excepts adding a step of pushing down on the outside springs before pulling out the swinging rails.

The rails are preferably formed of a toxically safe material such as steel which is powder coated during fabrication with no solvents utilized. The supporting blocks and swinging rails as-well as the stabilizing bar materials are also toxically safe preferably being molded of a high polymer plastic. These various parts may be constructed of ABS, acetate fiber or other moldable plastics of similar properties.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination of arrangement of parts may be resorted to without departing from the spirit and scope of the invention.

What is claimed is:

1. A crib capable of swinging in a natural rhythm, comprising:

a supporting frame having an upper rectangle and a lower rectangle, said upper rectangle and lower rectangle being connected through four vertical rails at four corresponding corners thereof;

a supporting block provided in each of said four corners of said lower rectangle respectively, a receiving hole being provided in the bottom surface of said supporting blocks;

a pair of swinging rail provided between two corresponding supporting blocks, said swinging rail having both ends extending in the direction parallel to said vertical rails and the mid section extending in a shape of arch, each end of said swinging rail being detachably connected to said supporting block with a connecting device through said receiving hole;

wherein said connecting device comprises a first spring panel of substantially V-shape provided inside the tube at the ends of said swinging rail, a protrusion being provided in one end of said spring panel, said protrusion extending through a throughhole provided in a corresponding position on said swinging rail, and a second spring panel provided in the surface of said supporting block, said second spring panel being coupled to said supporting block by providing a connecting means at one end of said second spring panel, a protrusion being provided in the inside surface of said second spring panel so as to align with the protrusion of said first spring panel.

2. The crib according to claim 1, wherein said connecting device comprises a clicking means provided in each end of said swinging rail, a releasing means provided in a position on said supporting block corresponding to said clicking means for releasing the clicking between said swinging rail and supporting block.

3. The crib according to claim 1, wherein said supporting block further comprises a stabilizing means for switching the crib from a swinging mode to a fixed mode.

4. The crib according to claim 3, wherein said stabilizing means is a rod pivotally coupled to said supporting block by providing a pivotal connecting means on the upper end of said rod.

* * * * *